United States Patent [19]

Horbruegger et al.

[11] Patent Number: 5,076,399

[45] Date of Patent: Dec. 31, 1991

[54] ELEVATOR START CONTROL TECHNIQUE FOR REDUCED START JERK AND ACCELERATION OVERSHOOT

[75] Inventors: Herbert K. Horbruegger; Bernd L. Ackermann; Peter L. Herkel; Mustapha Toutaoui, all of Berlin, Fed. Rep. of Germany

[73] Assignee: Otis Elevator Company, Farmington, Conn.

[21] Appl. No.: 589,861

[22] Filed: Sep. 28, 1990

[51] Int. Cl.[5] ..... B66B 1/28

[52] U.S. Cl. ..... 187/116

[58] Field of Search ..... 187/116, 118, 122

[56] References Cited

U.S. PATENT DOCUMENTS

| | | | |
|---|---|---|---|
| 4,155,426 | 5/1979 | Booker | 187/118 |
| 4,658,935 | 4/1987 | Holland | 187/122 |
| 4,751,984 | 6/1988 | Williams et al. | 187/116 |

*Primary Examiner*—A. D. Pellinen
*Assistant Examiner*—Lawrence E. Colbert
*Attorney, Agent, or Firm*—Francis J. Maguire, Jr.

[57] ABSTRACT

Start jerk and acceleration overshoot on elevator starting are reduced by bypassing and delaying application of an elevator closed loop velocity control system. A bypassing starting torque increases the torque of the motor before the onset of motion, at which time the starting torque is leveled off and held constant and the velocity speed reference profile is started. A small creep velocity dictation injected into the closed velocity loop in addition to the starting torque command causes the difference between the speed profile and the sensed speed to be very small during starting. Moreover, by selecting lift brake current in such a way as to promote a smooth brake opening and by selecting an increasing starting torque profile which overcomes the declining brake torque just after the brake begins to open, the torque needed to compensate for the load can be evenly balanced with the release of brake torque. The timing of initiation of the starting torque may be selected according to a time delay which may vary between different installations and be adjustable in order to obtain zero rollback when the elevator car first moves. A step decrease in the starting torque may be dictated upon detecting system movement in order to compensate for the transition from static friction to sliding friction. The rate of increase of starting torque is preferably exponential.

14 Claims, 13 Drawing Sheets

ELEVATOR START CONTROL TECHNIQUE FOR REDUCED START JERK AND ACCELERATION OVERSHOOT

REFERENCE TO RELATED APPLICATIONS

The invention described herein may employ some of teachings disclosed and claimed in commonly owned co-pending applications filed on even date herewith by Horbruegger et al, U.S. Ser. No. 07/589,859 entitled "Adaptive Digital Armature Current Control Method for Elevator Drives Using an SCR Generator Field Converter"; by Ackermann et al, U.S. Ser. No. 07/589,860 entitled "Control of a Discontinuous Current by a Thyristor Rectifier with Inductive Load"; and by Ackermann et al, U.S. Ser. No. 071/589,862 entitled "Adjusting Technique for a Digital Elevator Drive System."

TECHNICAL FIELD

This invention relates to elevator control and, more particularly, to start control.

BACKGROUND ART

During the starting phase of an elevator run in case of an unbalance between the weight of the car and the counterweight, the starting torque of the motor has to be set in a way to avoid sagging and to match reference values of jerk and acceleration.

Sagging of the elevator during starting is usually avoided by the use of one of two techniques:

1. With passenger load information:
   setting the motor torque equal to the load torque before opening the brake according to the load information coming from a load sensor.
2. Without load information:
   activating a velocity dictation profile before opening the brake, to produce a motor torque which relates to the load, thus pulling the elevator out of the brake.

Technique 1 requires a load sensor which increases the costs of the system.

Technique 2 is cost effective, but produces a start jerk and acceleration overshoot due to the following principal reasons.

To avoid sagging, the overlapping of the brake release and the velocity profile have to be adjusted for the worst case starting condition which is full load up. The starting motor torque demand, i.e., the velocity regulator output, is produced due to a tracking error between dictated and actual velocity. Due to the operation principle of the velocity regulator, this start tracking error will be reduced during the acceleration phase. This is done by increasing the acceleration and its slope, i.e, the jerk, until the dictated profile can be tracked.

In the case of an empty car, the torque produced in the motor when opening the brake is much too high. This will additionally increase the start jerk.

DISCLOSURE OF INVENTION

The object of the present invention is to provide for reduced start jerk and acceleration overshoot.

According to the present invention, start jerk and acceleration overshoot are reduced by a special open loop starting technique.

In further accord with the present invention, the transition of the elevator from standstill to movement is decoupled from the operation of tracking the velocity reference profile.

In still further accord with the present invention, motor torque is increased by a torque command signal until the elevator system starts moving in the desired direction.

In still further accord with the present invention, dictated motor torque is increased exponentially until the elevator moves.

In still further accord with the present invention, the rate of increase of the dictated motor torque during the starting process is kept the same for every installation and a time delay between the detection of the lift brake command and the beginning of the dictated starting torque profile is varied, depending on the installation, so that the moment at which the increasing starting torque overcomes the decreasing brake torque is timed to occur for the no load up condition to just after the brake actually begins to lift, but before it opens completely. This delay is thereafter held as a fixed delay until further adjustment may be required due to wear of the brake, typically after a long period of time on the order of five years or more. The time delay may be set at an initial value, e.g., 1.5 seconds, and then reduced, for example, for full load up, until the jerk is minimized, i.e., so that the car does not move in the wrong direction on startup, or the start time delay for delaying the torque function generation can be set in a way that sagging is avoided, i.e., the motor torque level corresponds to the load when the brake opens. This adjustment is made in a case of full load up condition to prevent sagging on startup but can be made for other conditions as well.

In still further accord with the present invention, a creep speed command is introduced along with a motor torque command.

In still further accord with the present invention, the velocity profile is started when the elevator is detected moving, thus avoiding large tracking errors during the starting phase.

In still further accord with the present invention, the slope of torque release in the holding brake is reduced to minimize excitation of the elevator system during the brake opening phase.

The present invention solves the problem of sagging and eliminates the need to match reference values of jerk and acceleration. It does this by decoupling the operation and tracking the velocity reference profile from the transition of the elevator from standstill to movement. It also does this by substituting torque dictation after brake release is initiated and only initialing a small dictated creep speed at the same time. The velocity profile is not started until after the car is detected as having moved.

Thus, the present invention provides a new teaching which will significantly enhance elevator operations on startup to reduce the passenger perception of sagging, start jerk, and acceleration overshoot.

These and other objects, features and advantages of the present invention will become more apparent in light of the following detailed description of a best mode embodiment thereof, as illustrated in the accompanying drawing.

BRIEF DESCRIPTION OF THE DRAWING

FIG. 8(*b*) shows the region of FIG. 8(*a*) where motion is first detected in greater detail;

FIG. 9(*b*) shows the region where motion is first detected in FIG. 9(*a*) in greater detail;

BEST MODE FOR CARRYING OUT THE INVENTION

Figure 1:
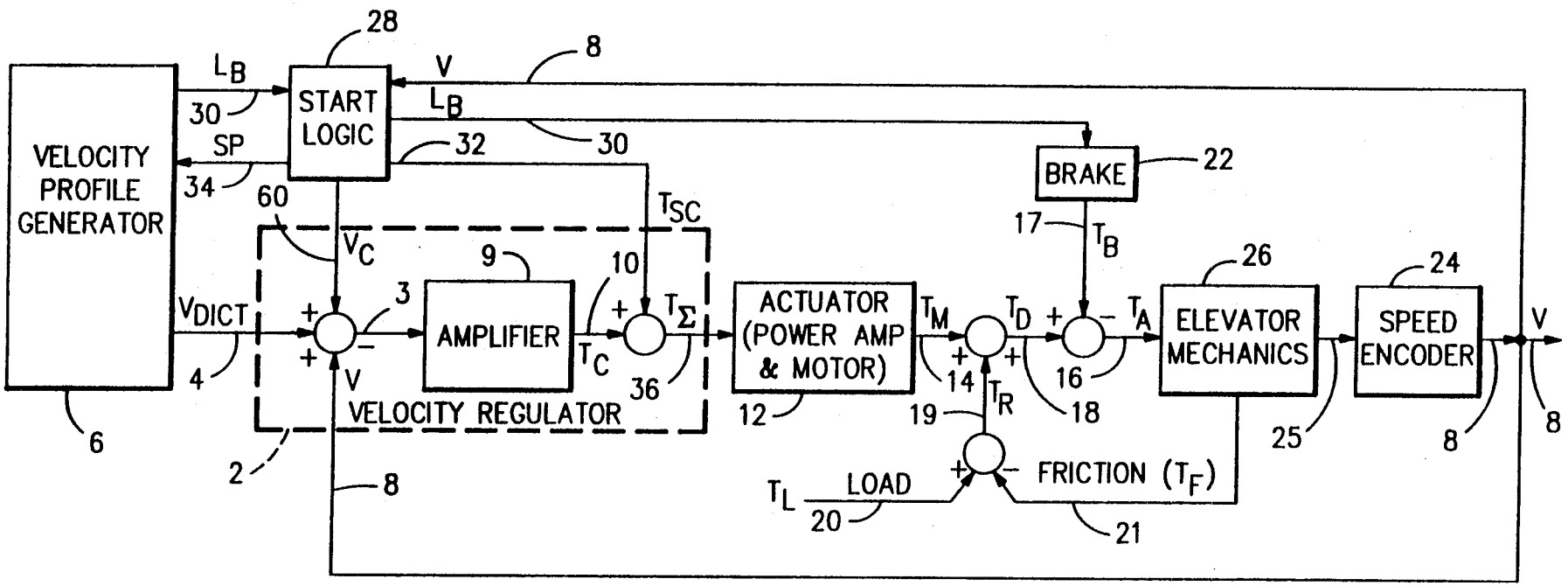
FIG. 1 is an illustration of a closed loop velocity control scheme used for elevators, according to the present invention.

A closed loop velocity control scheme, according to the present invention, is shown in FIG. 1. A velocity regulator 2 provides a difference signal on a line 3, indicative of the difference between a dictated velocity signal on a line 4, provided by a profile generator 6, and an actual velocity signal on a line 8, to an amplifier 9 which in turn provides a motor torque command ($T_c$) signal on a line 10. An actuator 12 which may be a power amplifier and a motor, but which may be of different types, such as Ward-Leonard Drive, Direct Drive DC (DC motor fed by a controlled rectifier), VV or VF drive systems, produces a physical torque on the motor axes as shown by a torque signal ($T_m$) on a line 14, primarily under normal operating conditions, due to the torque command signal on line 10 but as modified during starting in a way to be described later. Any elevator movement will be activated by an acceleration torque ($T_A$) signal as indicated on a line 16 which is provided by the difference of a brake torque ($T_S$) signal on a line 17 and a torque drive ($T_D$) signal on a line 18. The torque drive signal on line 18 is the sum of a motor torque signal ($T_M$) on a line 14 and a resultant torque ($T_R$) signal on a line 19 representative of the difference between a load torque ($T_L$) signal on a line 20 and a friction torque ($T_F$) signal on a line 21. A brake 22 is responsible for providing the brake torque signal on line 17. A speed encoder 24 is mounted on motor axis 25 which drives an elevator mechanical system 26 which is responsible for a sticky friction (or "sticktion") component of the friction torque signal on line 21.

Start Logic 28 uses the actual velocity signal on line 8, and a lift brake command signal on a line 30 coming from the Profile Generator 6 to generate a starting torque command signal on a line 32 and to send a start speed profile command signal on a line 34. The start torque command ($T_{sc}$) signal on line 32 is added to the torque command ($T_c$) signal on line 10 from the velocity regulator amplifier 9 and a summed torque command ($T_\Sigma$) signal on a line 36 is provided to the actuator (power amplifier and motor) 12. The lift brake ($L_B$) signal is also provided to the brake 22 to initiate brake lift.

Figure 2:
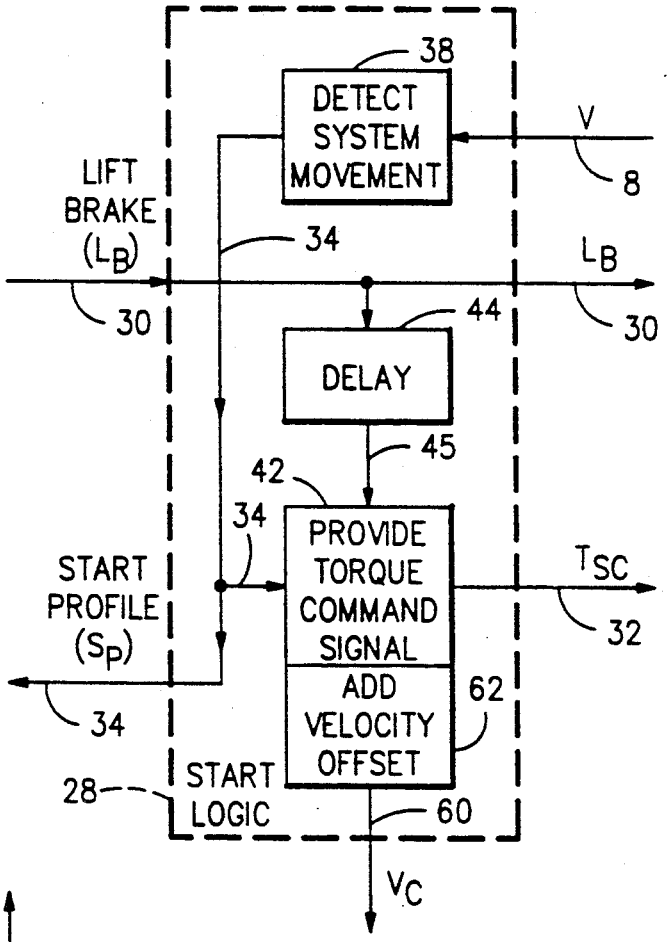
FIG. 2 is a detailed illustration of the start logic of FIG. 1.

FIG. 2 shows the principal internal operation blocks of the Start Logic 28 of FIG. 1. Car or motor axis movement, as indicated by the velocity signal on line 8, is detected or registered by a system movement detector 38. If the velocity is different from zero, the SP signal on the line 34 is then provided to the Profile Generator 6, and the then current magnitude of the torque command signal on line 32, which is an output of a Torque Function Generator 42, is thereafter held constant. The Generator 42 would have previously been activated by the lift brake command signal on the line 30 which may be delayed by a delay element 44. A signal on a line 45 is provided after a selected delay period to be explained later.

Figure 3A:
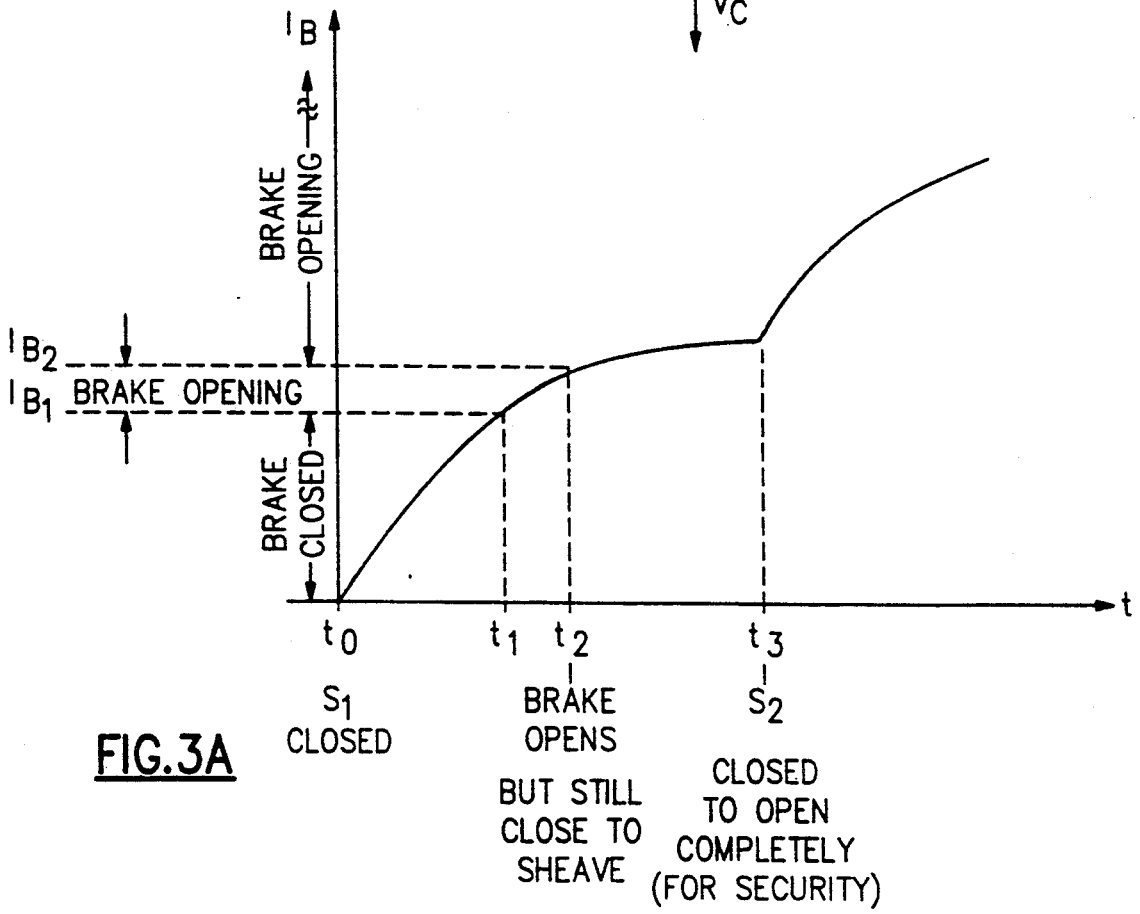
FIG. 3A shows the operation of the brake.
Figure 3B:
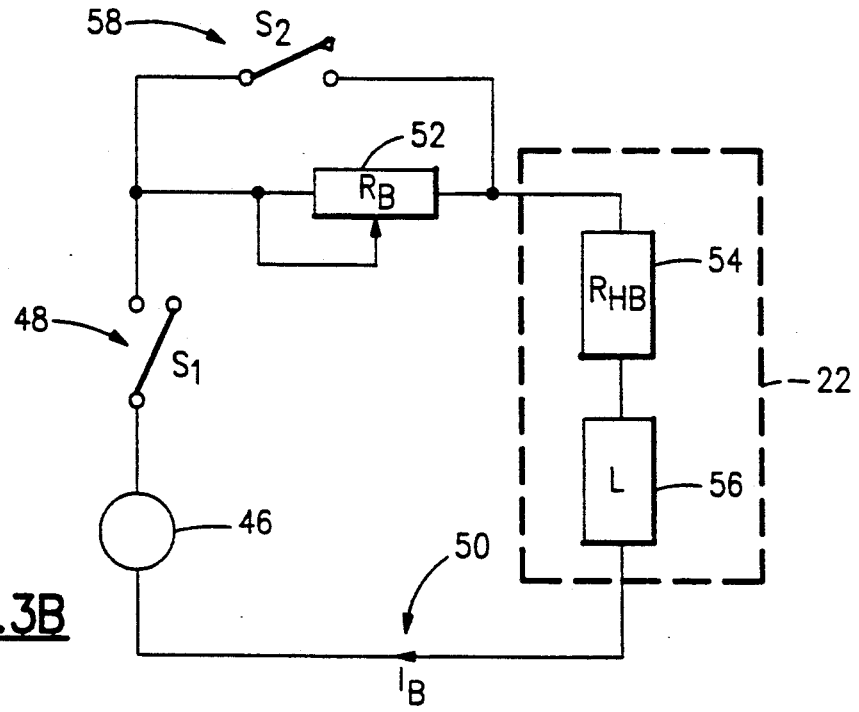
FIG. 3B shows an electrical arrangement which allows smoothing of the brake release.

FIG. 3A shows the operation of the brake 22 of FIG. 1 and FIG. 3B shows an electrical arrangement which provides for smoothing of the brake release. After switching on a brake voltage 46 by means of a switch 48 at time $t_o$, a brake current 50 ($I_B$) increases according to a time constant determined according to the brake circuit components. FIG. 3A shows when the brake starts opening at a time $t_1$ at a special value of the brake current ($I_{B1}$). An adjustable resistor 52 ($R_B$) can be inserted in series with the voltage source 46, the switch 48 and the brake 22 (which may be represented as a resistor ($R_{HB}$) 54 and inductor (L) 56). The resistor 52 may be adjusted in magnitude such that the slope of the brake current is very low in the area where the brake opens from time $t_1$ to a time $t_2$. This will lead to a smooth brake operation, i.e., the time slope of the brake torque, which will excite the elevator mechanical system, is reduced. To be sure that the brake 22 is completely opened during the elevator run, a switch 58 ($S_2$) can be closed to assure a full safety brake lift after smooth opening by increase of the brake current ($I_B$) as shown in FIG. 3A at a time $t_3$. A time of, for example, 850 to 950 milliseconds may be selected as the time between starting at $t_0$ and a time at which a first encoder pulse is measured or registered by detector 38 when the brake is lifted.

The smooth operation of the brake can also be achieved by other techniques, such as open loop control of the brake voltage (ramp up of brake voltage) or closed loop control of the brake current.

Figure 4:
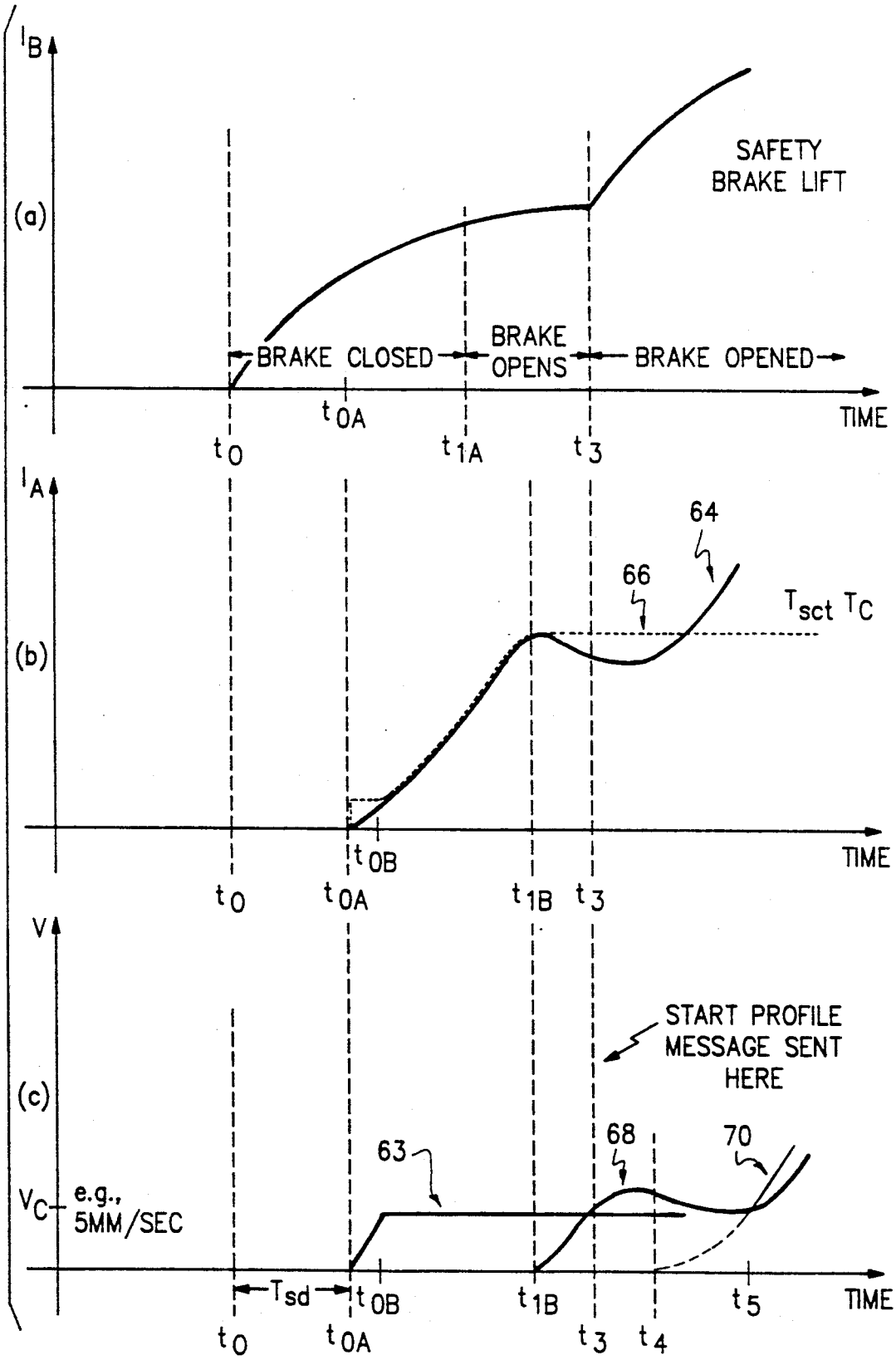
FIG. 4 shows the operation of the system of FIG. 1 during the starting phase of the elevator.

FIG. 4 shows the operation of the system during the starting phase of the elevator, according to an important teaching of the present invention.

First, the brake is activated at the time $t_0$, and the brake current increases as shown in FIG. 4(*a*). After a start delay time ($T_{sd}$) ending at time $t_{OA}$, the Torque Function Generator 42 sends the torque ramp profile signal ($T_{sc}$) on line 32 to the actuator 12, e.g., by injection into an armature current loop. The start time delay ($T_{sd}$) can be set in the field to expire at the time $t_{OA}$ before the brake starts opening at a time $t_{1A}$ in such a way that the increasing starting torque command profile on line 36 reaches a magnitude sufficient to overcome the decreasing brake torque after the brake starts to open, but before it opens completely, when the torque needed to overcome the load in the elevator car is still offset by sliding friction of the brake. The most desirable setting will be for avoiding "sagging" in case of a full load up condition. Or it can be similarly adjusted to prevent car movement in the wrong direction at the instant of car movement for empty up. This may be done in the field for the full load up condition by fully loading the car, commanding an up floor rung, starting at a high value of time delay, e.g., 1.5 seconds for a brake opening of 0.85 to 0.95 seconds, and then measuring the "rollback", i.e., the amount the car moves down before starting to move up in the commanded direction. Then one may successively reduce the time delay in steps, ultimately, for the example given, to a much lesser time delay (on the order of one-half second) until measured rollback is zero. This approach causes the dictated torque profile to be shifted for each particular installation without changing its desired slope for smooth brake opening.

Additionally, a creep velocity reference signal on a line 60 may be provided and, if provided, is set to a small creep speed level ($V_c$) as shown in FIG. 4(*c*). A velocity offset means 62 associated with start logic 28 provides the offset signal on the line 60 in response to the delayed lift brake signal on the line 45 at the same time as the starting torque dictation signal on line 32 is provided. We call this the dictated creep speed as shown in a plot 63 in FIG. 4(*c*). FIG. 4(*b*) illustrates starting torque dictation and response during startup, according to the present invention. Armature current is proportional to torque and a measured armature current ($I_A$) plot 64 is shown following a dictated armature current signal plot 66 corresponding to and equivalent to the torque command signal on line 32 plus the torque command signal on line 10 (which only contributes a creep component during startup, the speed profile generator being inactive until movement is detected).

Thus, the motor torque will be increased until movement is detected on line 8 at a time $t_{1B}$ as shown at that time and subsequently by a plot 68 of measured speed in FIG. 4(*c*). The SP signal on line 34 (see FIGS. 1 and 2) will hold the torque dictation ($T_{sc}$) signal on line 32 at its then current level as shown in plot 66 on FIG. 4(*b*).

The preceding dictation of a small creep velocity level ($V_C$) (roughly corresponding in magnitude to the speed at which the car will be moving anyway due to the introduction of the starting torque) is provided in order to avoid a condition that would cause the velocity regulator (being already active) to stop the car after the torque dictation ($T_{SC}$) signal is kept constant. The SPN signal will additionally start velocity tracking when the dictated speed profile on the line 4 exceeds the dictated creep speed level, the velocity loop control will follow the dictated speed profile.

Thus, fill scale speed profile tracking starts when the system is already moving the low speed. I.e., the operation of the velocity regulator 2 will now set the torque ($T_\Sigma$) dictation according to the velocity reference profile curve 70 as shown in FIG. 4(*c*). The time delay $t_{1B}$ to $t_3$ is the time the software needs to react to the detection of car movement and to send the SP signal and would be a delay of a maximum of five milliseconds. The time delay $t_3$ to $t_4$ is the reaction time of the velocity profile generator, which would be about 30 milliseconds.

Due to this technique, according to an important teaching of the present invention, the transition of the elevator from standstill to movement is decoupled from the operation of tracking the velocity reference profile, thereby avoiding the start jerk and acceleration problems of the prior art.

As previously explained, the start time ($T_{sd}$) delay from $t_O$ to $t_{OA}$ delays the starting torque function generation and should be set in a way that sagging is avoided, i.e., the motor torque level corresponds to the load when the brake opens. The adjustment can be made in case of full load up condition. But the setting should also allow room for ensuring the increasing starting torque exceeds the decreasing brake holding torque for the case of an empty car commanded up only after the brake starts opening. This may be set once for each particular elevator system and left that way.

Figure 5:
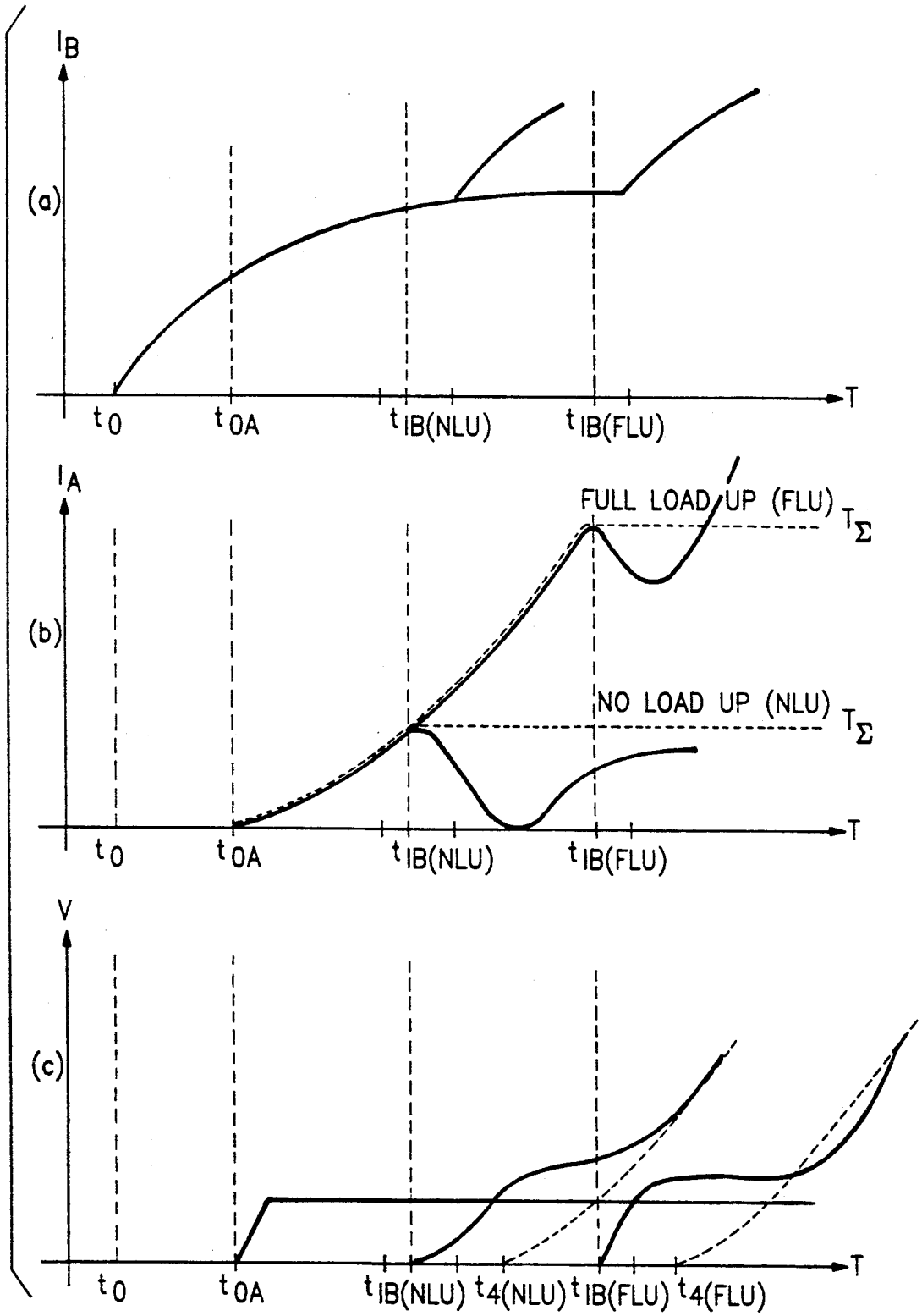
FIG. 5 shows the influence of different load conditions to the starting process.

FIG. 5 shows the influence of different load conditions to the starting process. In the case of no load up (NLU), car movement will occur earlier, at time $t_{1B(MLU)}$, than in the case of full load up (FLU) condition at time $t_{1B(FLU)}$. Thus, for a less than fully loaded car, the starting torque "ramp" will be stopped and thereafter held constant at a smaller torque level than in the case of a fully loaded car. Due to the feedback mechanism given by the detection of the car movement and stopping of the torque ramp, the actual starting torque relates closely to the load torque of the elevator. The torque value is a function of the timing process during the start operation.

In principle:

immediate start of movement indicates generating load;

delayed start of movement indicates motoring load,

Due to this principle, according to an important teaching of the present invention, the Torque Function Generator 42 outputs an exponential profile, which weights the time delay in a more suited way according to the functional relationship of load condition and instant of car moving.

Figure 6:
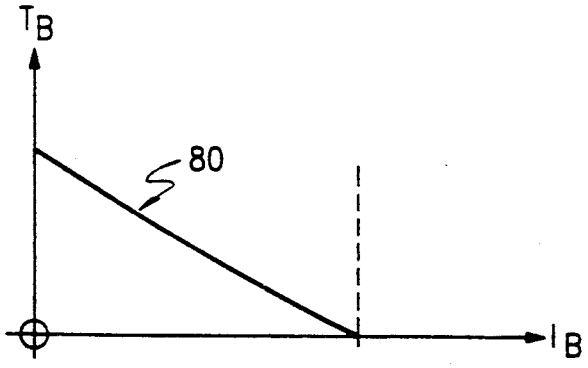
FIG. 6 illustrates the relation between brake tongue and brake current.
Figure 7:
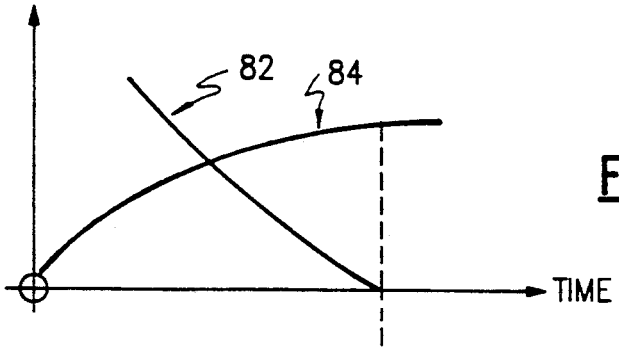
FIG. 7 illustrates brake torque and brake current during starting.
Figure 8A:
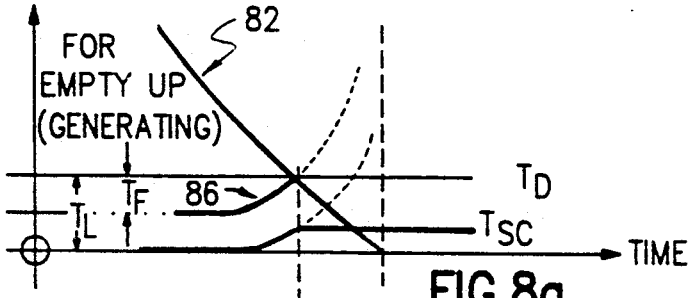
FIG. 8(*a*) shows torque slopes for an "empty-up" run.
Figure 8B:
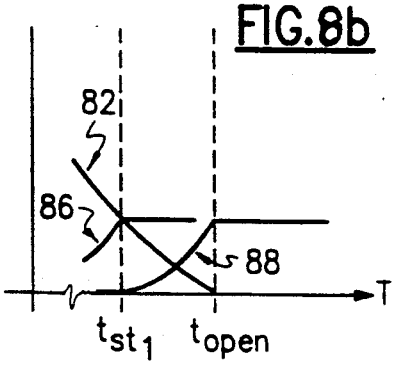
Figure 9A:
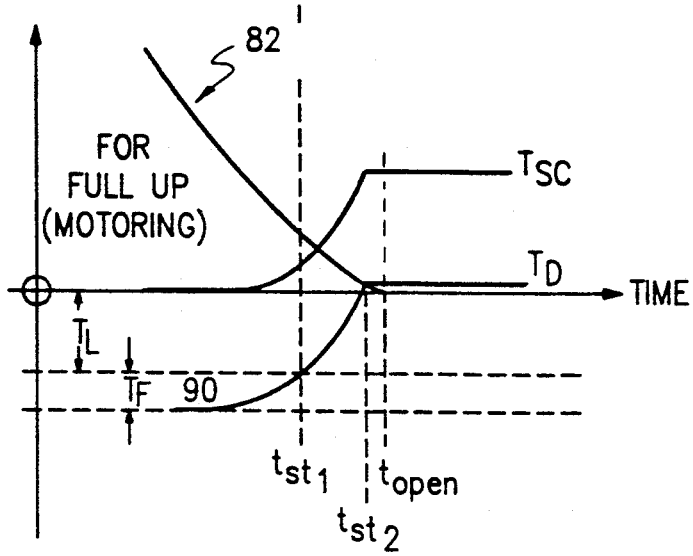
FIG. 9(*a*) shows the starting process for a "full-up" run.
Figure 9B:
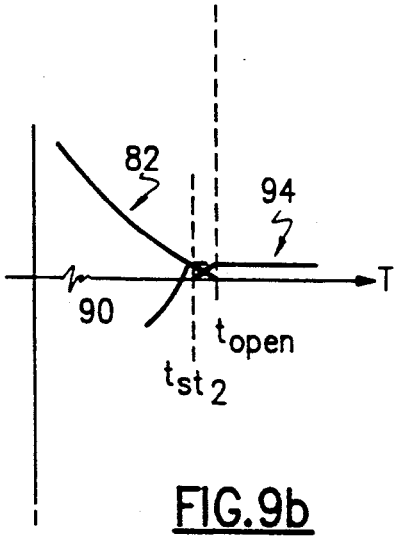

FIGS. 6 to 9 show the traces of torques and drive states during the elevator starting process. FIGS. 7–9 are related to each other by the same time line.

FIG. 6 shows the principal relationship 80 of brake torque ($T_B$) versus brake current ($I_B$).

FIG. 7 indicates the slope of the brake torque 82 as a result of the exponential increase of brake current 84. At time instant ($t_{open}$), the brake is completely open, i.e., the brake torque is zero.

Referring back to FIG. 1, the interaction of the torques that will affect the starting process may now be reviewed. The motor torque ($T_M$) on the line 14 is mainly equal to the start torque dictation signal ($T_{sc}$) on line 32 during startup. Load torque ($T_L$) on line 20 and friction (sticky or static friction) torque ($T_F$) on line 21 are added to the motor torque ($T_M$) on line 14 and result in the driving torque ($T_D$) on line 18. The difference between the driving torque ($T_D$) on line 18 and the brake torque ($T_B$) on line 17 is the acceleration torque ($T_A$) on line 16 that will cause the elevator car to move when $T_D$ exceeds $T_B$.

FIG. 8(*a*) shows torque slopes in case of a generating load condition, i.e., an "empty up" run. The brake torque 82 decreases to zero according to its specific slope, that is, more or less exponential as shown also in FIG. 7. If the driving torque ($T_D$) 86 is bigger than the brake holding torque ($T_B$) 82, the elevator starts moving as indicated at time instant $t_{st1}$. The driving torque ($T_D$) 86 is given by:

$$T_D = T_L - T_F + T_{sc}, \text{ where } T_M = T_{sc}$$

After time instant ($t_{st1}$), the acceleration torque ($T_A$) 88 increases due to the decrease of brake torque 82 as shown in detail in FIG. 8(*b*). Thus, the acceleration of the elevator is determined by the brake sliding friction behavior, i.e., the slope of the brake torque. In order to show the principal of operation, it is assumed that the friction torque will not change at the time instant of moving. Handling of friction changes will be explained later.

FIG. 9 shows the starting process in case of a motoring load, i.e., a "full up" run. Due to the direction of load torque and friction torque, the driving torque ($T_D$) 90 is largely negative. Elevator movement occurs if the driving torque is bigger than the brake torque, as indicated at time instant ($t_{st2}$) that occurs later than the time instant ($t_{st1}$) of movement for empty up. The resulting acceleration torque ($T_A$) 94 is indicated in FIG. 9(*b*). It is much smaller than in the case of a start with generating load as previously shown in FIG. 8(*b*).

The driving torque at the time instant of moving $t_{st}$ should be as small as possible in order to make the starting process less dependent on brake torque behavior and to reduce the sliding operation of the brake.

Figure 10:
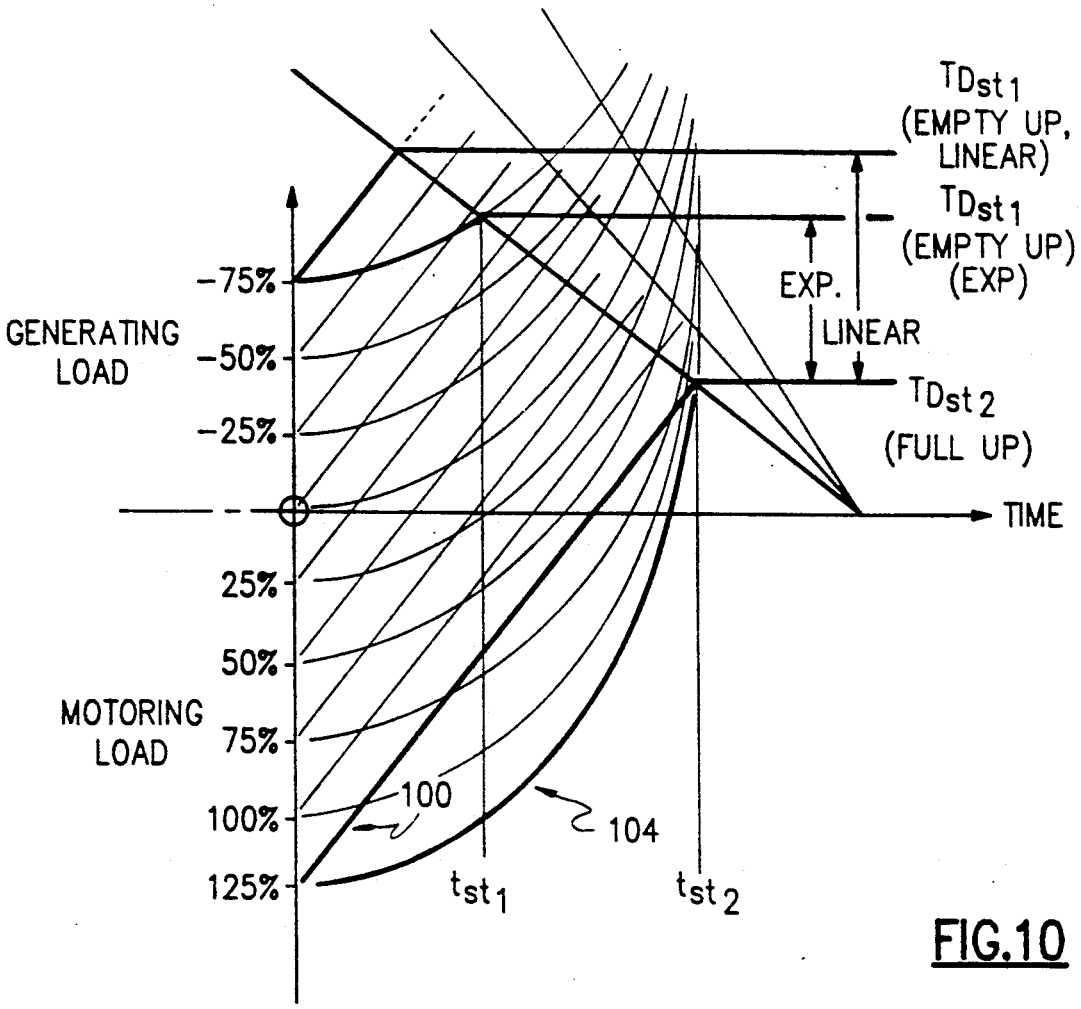
FIG. 10 shows the influence of different load torques on the starting process.

FIG. 10 shows in more detail the influence of different load torques to the starting process. The sum of load torque and friction torque is varied in 25% increments from −75% generating to 125% motoring due to the direction of the friction (sticky friction) that is always opposite to the run direction. It is assumed for purposes of illustration that the friction torque is 25% of the load torque. It may be seen that the spread of driving torque magnitudes is reduced using an exponential starting torque command signal and the magnitude of driving torque for the empty up condition is brought closer to that of the full up condition.

Figure 11:
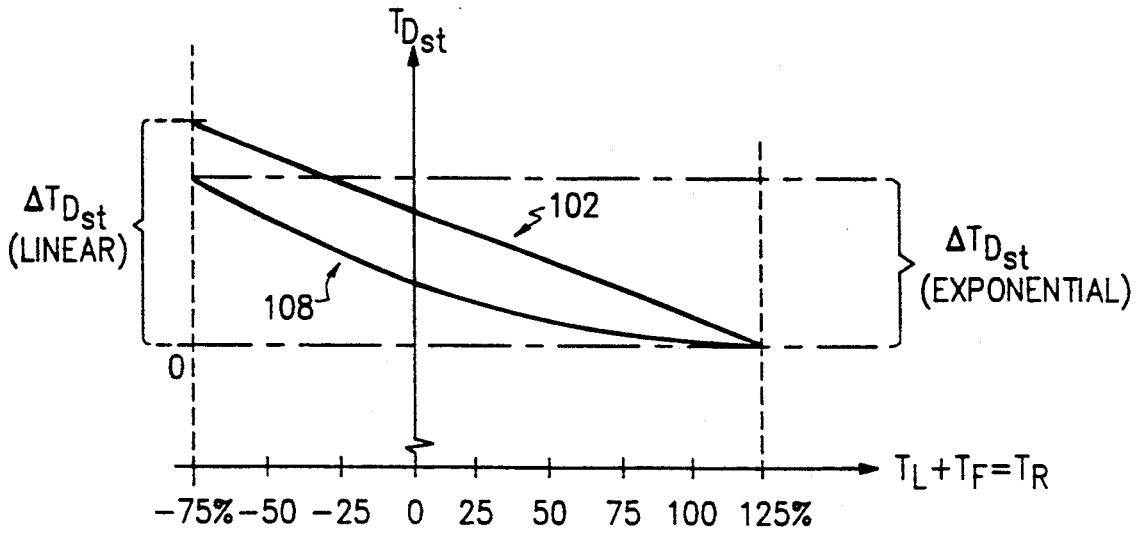
FIG. 11 shows how the brake will be operated less in a sliding condition for an exponential profile than in the case of a linear ramp.

A similar concept is shown in FIG. 11 which shows the relationship of drive torque $T_{Dst}$ at time instants of moving ($t_{st}$) versus the load condition.

If the starting torque profile ($T_{sc}$) is maintained by a linear curve as indicated, for example, by a line 100 in FIG. 10, the relationship 102 between ($T_{Dst}$) and $T_R$ will also become linear.

For purposes of illustration, the linear ramp profile 100 shown in FIG. 10 is shaped in a way that its time instant of moving is the same as that of the exponential torque profile 104 in case of "full load up" 125% motoring condition, i.e., the time instant of moving ($t_{st2}$) is equal when using both the exponential and linear profiles.

It will be seen that the exponential slope of the start command ($T_{sc}$) will result always in a desired smaller driving torque ($T_{Dst}$), especially in the case of generating load than will result when the slope is linear. This is shown in FIG. 11 by the difference between driving torques at full load up (125%) and empty up (−75%) for the linear relation 102 and an exponential relation 108. Thus, the brake will be operated less in a sliding condition for an exponential profile than in the case of the linear ramp.

This is the main advantage of an exponential starting torque ($T_{sc}$) profile, according to an important teaching of the present invention.

Figure 12:
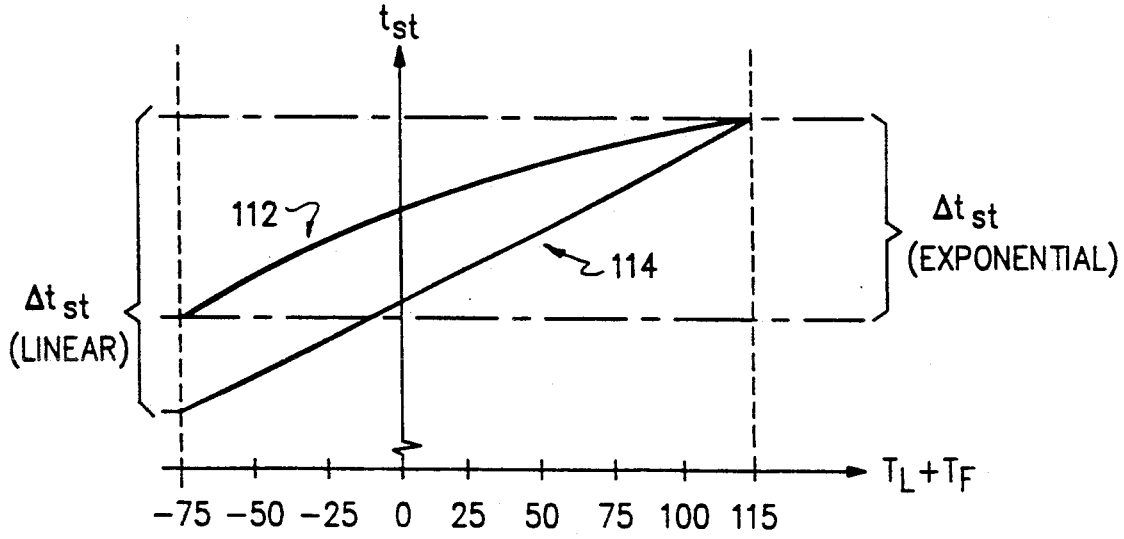
FIG. 12 shows how the time instant of moving will vary in a smaller range for an exponential profile than a ramp profile.

Also, the time instant of moving ($t_{st}$) 112, 114, as shown in FIG. 12, will vary in a smaller range for an exponential $T_{sc}$ profile than in the case of a ramp profile $T_{sc}$.

Thus, the exponential starting torque slope can be seen as a preferred approach in practicing the invention since it helps reduce brake wear.

An additional aspect of the invention can also be achieved if the starting torque profile is adapted to the sticky friction behavior of the mechanics.

Figure 13:
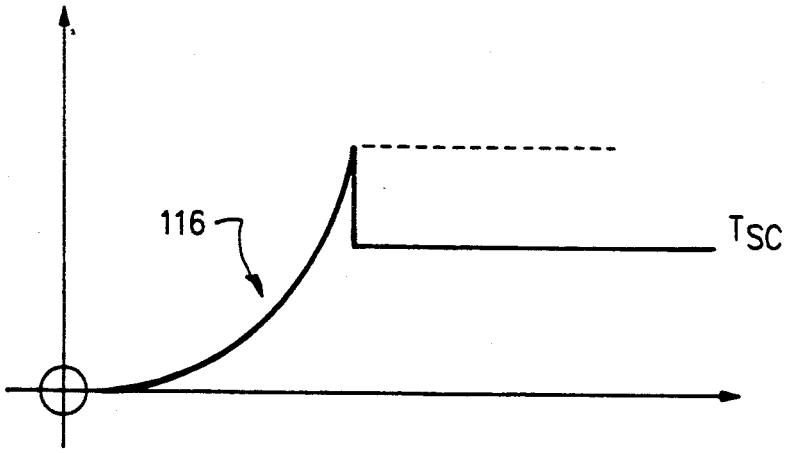
FIG. 13 shows a step reduction of the starting torque command at the time instant of moving to compensate for a friction variation from sticky friction to sliding friction.

At the time instant of elevator moving, the sticky friction force will decrease to the sliding friction force which is much smaller. Thus, the driving force ($T_D$) suddenly becomes too high. The starting process may be improved in advance by a step reduction of the starting torque command signal ($T_{sc}$) on line 32 at the time instant of moving, to compensate for the friction variation process. The resulting starting torque profile 116 is shown in FIG. 13.

The amount of starting torque reduction can be adapted to the difference of sticky friction to sliding friction for particular designs or installations.

Figure 14:
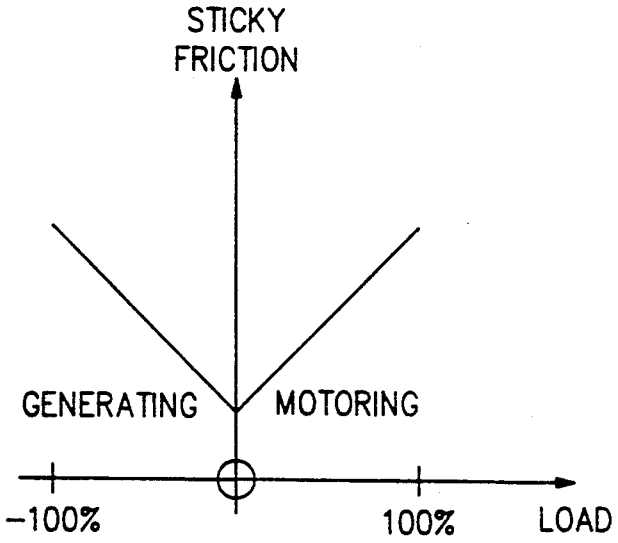
FIG. 14 shows that sticky friction is dependent on load.

The elevator sticky friction is also dependent on load as shown in FIG. 14.

Thus, the amount of step change ($T_{step}$) can be varied to the amount of starting torque achieved at the time instant of moving ($t_{st}$) that gives information about the loading condition.

Figure 15:
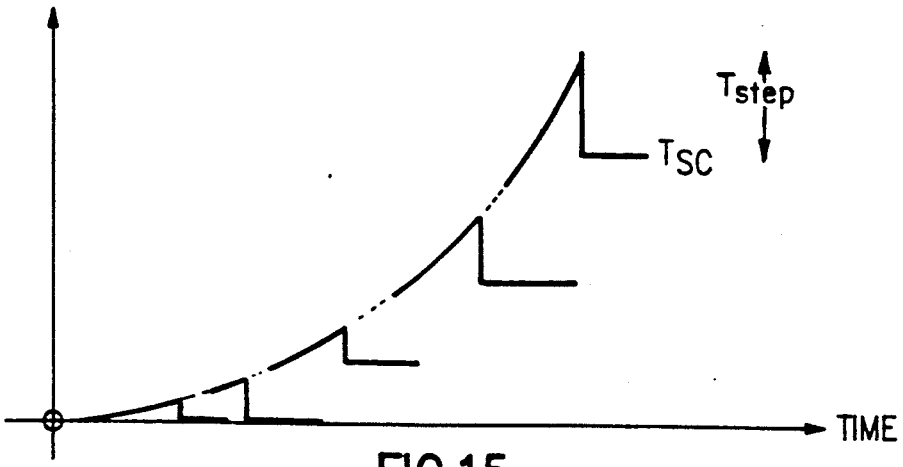
FIG. 15 shows how the amount of step change can be varied according to the amount of starting torque achieved at the time instant of moving.

The resulting starting torque profile will become a shape as shown in FIG. 15. The step reduction of torque ($T_{step}$) relates to the starting torque ($T_{sc}$) at time instant of moving ($t_{st}$) according to the functional relationship shown in FIG. 16. $T_{step}$ is designed to compensate for the difference between sticky friction and sliding friction. As the sticky friction is proportional to the load (see FIG. 14) and the starting torque ($T_{sc}$) is roughly proportional to the load (see FIG. 11), one can transfer FIG. 14 into FIG. 16. In the region of increasing generator load (from a certain load on), the $T_{step}$ decreases to zero according to FIG. 15, because negative values of $T_{sc}$ after the step are avoided and limited to zero.

Figure 16:
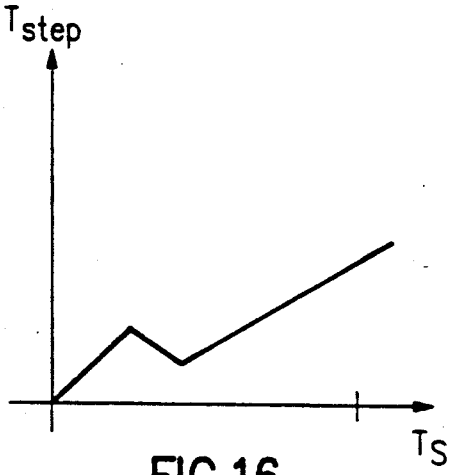
FIG. 16 relates the starting torque to the size of the step.
Figure 17:
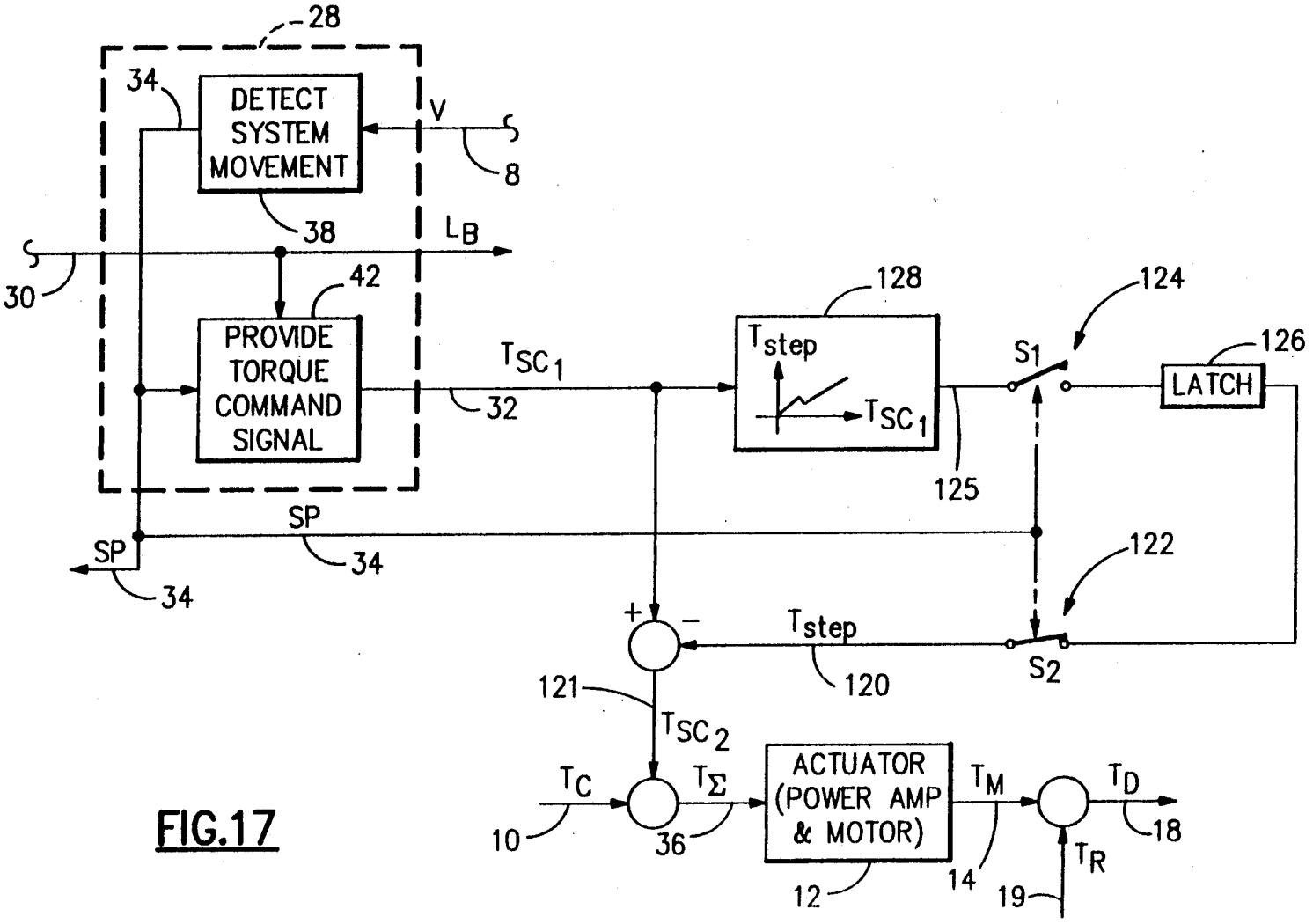
FIG. 17 shows a block diagram of how to concretely handle such frictional changes during the starting process.

FIG. 17 shows the block diagram which teaches how to concretely handle such friction changes during the starting process. Thus, the torque command signal on line 32 provided in FIG. 2 is modified at the time that system motion is detected by summing a signal on a line 120 with the signal on line 32 in order to further provide a summed signal on a line 121 in order to provide a torque profile similar to that shown in FIG. 13. This is accomplished by causing a switch 122 to close when the signal on line 34 indicates that system movement has been detected. At that time, a switch 124 which had been previously closed is opened, and the current value of a signal on a line 125 is then stored in a latch 126 and is provided at that magnitude by the switch 122 as the signal on line 120. Means 128 is provided having a relationship as shown in FIG. 16 provided the level of $T_{step}$ in response to the magnitude of the torque start command signal on line 32 at the time instant of moving.

Figure 18:
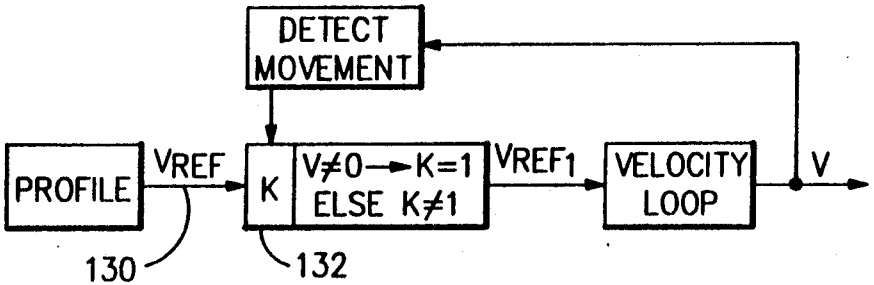
FIG.18 Prior Art
FIG. 18 shows a prior art gain changing circuit for use in a velocity loop during startup.

Referring now to FIG. 18, a prior art system as disclosed in U.S. Pat. No. 4,828,975 of Klingbeil et al is there summarized. Torquing of the drive during the starting phase is done by multiplying the speed reference profile on a line 310 by a loop gain factor (K) 132 that can be adjusted to the friction or load condition.

Figure 19:
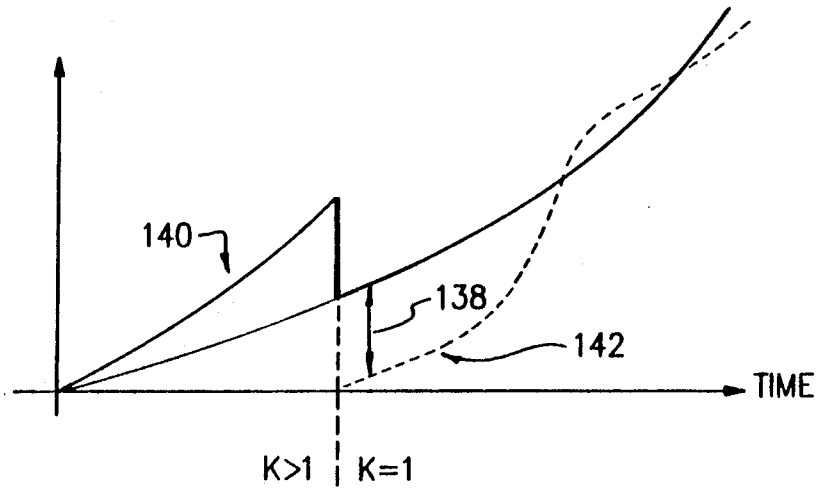
FIG.19 Prior Art
FIG. 19 shows a velocity reference profile such as would be used in the circuit of FIG. 18.

In the time instant of moving, the factor will be reset to 1; thus, the original profile will be sent to the velocity loop. The velocity reference will then take on a shape as shown in FIG. 19.

The disadvantage of this technique is that at the time instant of moving, a tracking error 138 between a reference velocity 140 and actual velocity 142 always exists. The tracking error relates to the variation of (K).

The klingbeil et al patent disclosure mainly takes care of the handling of the friction change in the elevator system at starting that might be compensated for by this technique.

Start jerk and acceleration overshoot will also be affected by the tracking error at starting, because the velocity loop will compensate for this error and will increase acceleration and jerk at starting.

The Klingbeil et al patent disclosure gives no information how this is handled.

It is also not stated how the starting process is synchronized with respect to the brake operation.

Returning now to the discussion of the present disclosure, according to another aspect of the present invention, the performance of the start technique can be increased using a selected initial level of torque dictation. This can be done by setting the initial value according to load information, which may be more or less precise due to the kind of load sensor used, such as a simple load contact or an analog load sensor. Thus, no special refinement of the starting technique is necessary to include more load information.

The technique can also be transferred to different kinds of drives. In each case, torque dictation may be used to influence that signal which will produce a physical torque in the drive.

For a VF drive, this can be the slip frequency or voltage dictation.

For a voltage controlled AC drive, the torque dictation can be transformed to the firing angle of the thyristors. Due to the operation of the dictation during standstill of the elevator, the relationship between torque and firing angle is given by a fixed nonlinear function. Thus, the technique can also be used when including a suited function to compensate for a nonlinear torque/firing angle relationship.

Figure 20:
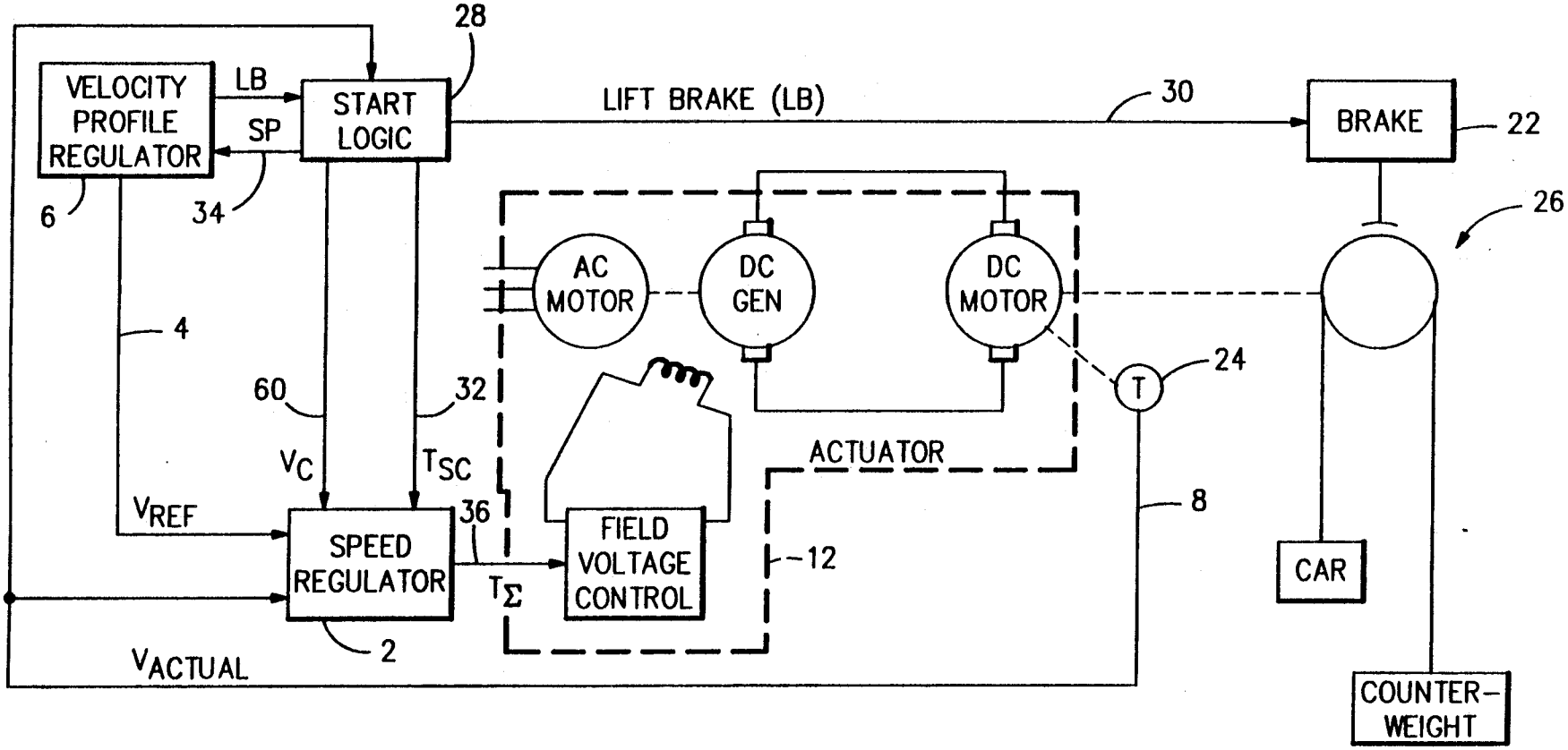
FIG. 20 shows an embodiment of the present invention as practiced in a Ward-Leonard control system.
Figure 21:
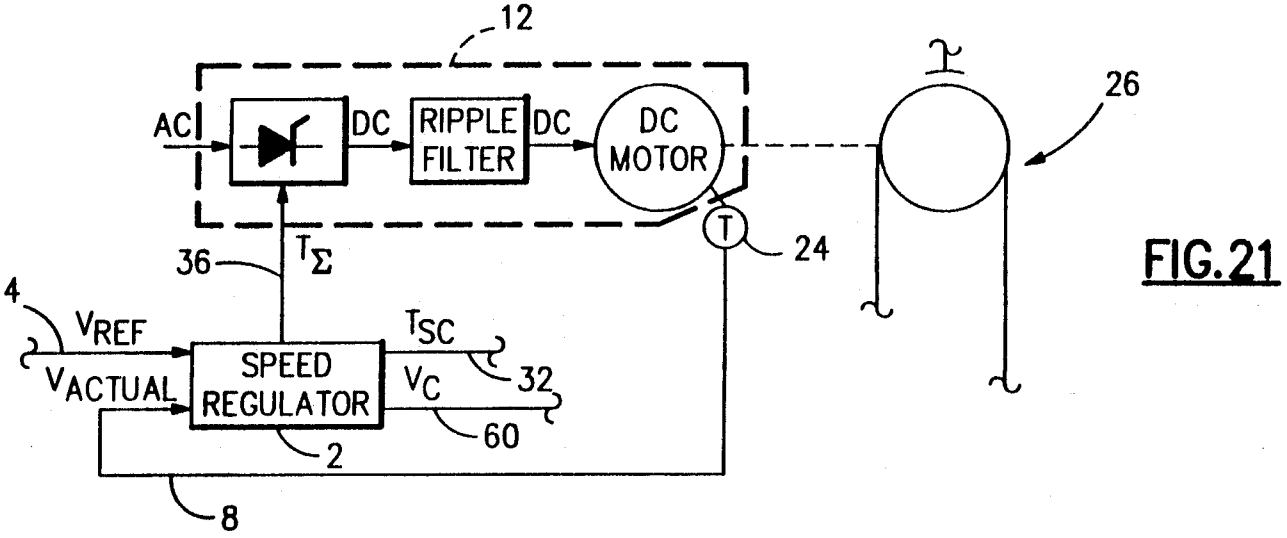
FIG. 21 shows an embodiment of the present invention as carried out using a DC Direct Drive control system.
Figure 22:
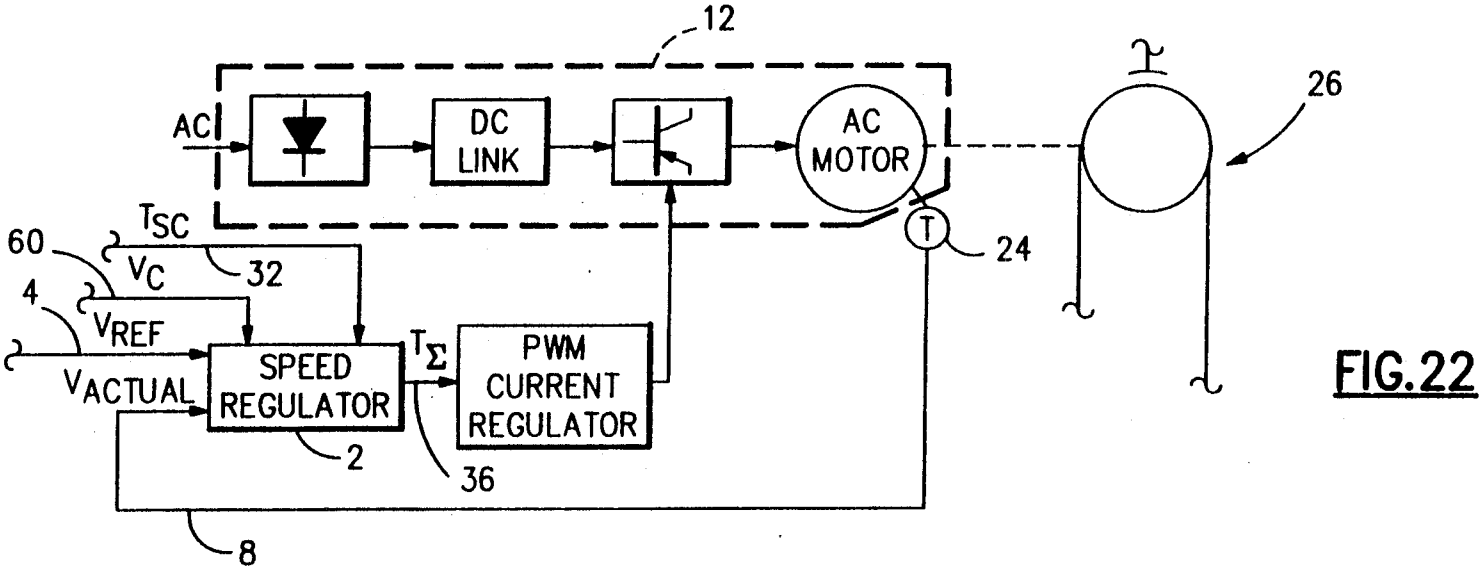
FIG. 22 shows an embodiment of the present invention using an AC VV VF Drive control system.

Among these various different actuators are shown three examples in FIGS. 20, 21, and 22, without limiting the scope of the invention to other actuators not shown in detail.

In FIG. 20 is shown an actuator 12 comprising a typical Ward-Leonard control system, such as is described in detail in "Control of Electrical Drives" by W. Leonhard in Section 7.4 entitled "Supplying a Separately Excited DC Motor from a Rotating Generator" published in 1985 by Springer-Verlag, Berlin, Heidelberg. An earlier reference to a Ward-Leonard drive appears at Section 12.83 at page 12–59 under Section 82 of "Standard Handbook for Electrical Engineers" edited by Donald G. Fink and published in a tenth edition in 1968 by McGraw-Hill. Some of the actuator and elevator mechanical elements shown in more abstract form in FIG. 1 are shown in FIG. 20 for a particular Ward-Leonard embodiment, in more detail.

Similarly, in FIG. 21, is shown a DC direct drive control system. The motor-generator set of FIG. 20 is replaced as a power converter by virtually maintenance free solid state devices. Thus, a direct current drive is shown in FIG. 21 which interfaces a traditional gearless machine. This system uses a bridge of high current silicon controlled rectifiers which is connected across the incoming three-phase supply and fired by a microprocessor to produce the dictated level of Dc voltage across the armature of the machine.

In FIG. 22 is shown a variable frequency (VF) drive which had begun to be used for many installations. These drives use a somewhat more complex power electronics configuration to obtain a sinusoidal AC voltage of varying amplitude and frequency to drive an AC machine. When a VF drive is used, the traditional DC gearless machine is replaced by an AC version. Some significant benefits are obtained, including an improved power factor, less harmonic distortion of the main power supply, and no commutator maintenance.

It will be, of course, understood that many other configurations of actuators and elevator mechanics, other than those shown in detail in FIGS. 20–22, may be utilized in practicing the present invention. In showing the various control elements within separate functional "blocks" in the various figures herein, including FIGS. 1 and 2, there is of course no intent to limit the invention to separately enclosed or necessarily separated functional entities. All of these functions may be accomplished in the same or separate devices and are shown separately mainly for teaching purposes. Thus, it will be understood that the velocity regulator 2 of FIG. 1 may include the summing junction that is responsive to the creep speed dictation signal on line 60, the actual detected velocity signal on line 8, and the velocity dictation signal on line 4. Similarly, the velocity regulator may or may not include the summing junction that is responsive to the signals on line 32 and line 10. Similarly, the start logic 28 may be physically incorporated in a velocity regulator 2 or a velocity profile generator 6, or all of these may be incorporated in a single printed circuit board without limitation. Of course, they may all also be included on separate PC boards within a single enclosure which also includes the power amplifier and other controls for controlling the motor.

Figure 23:
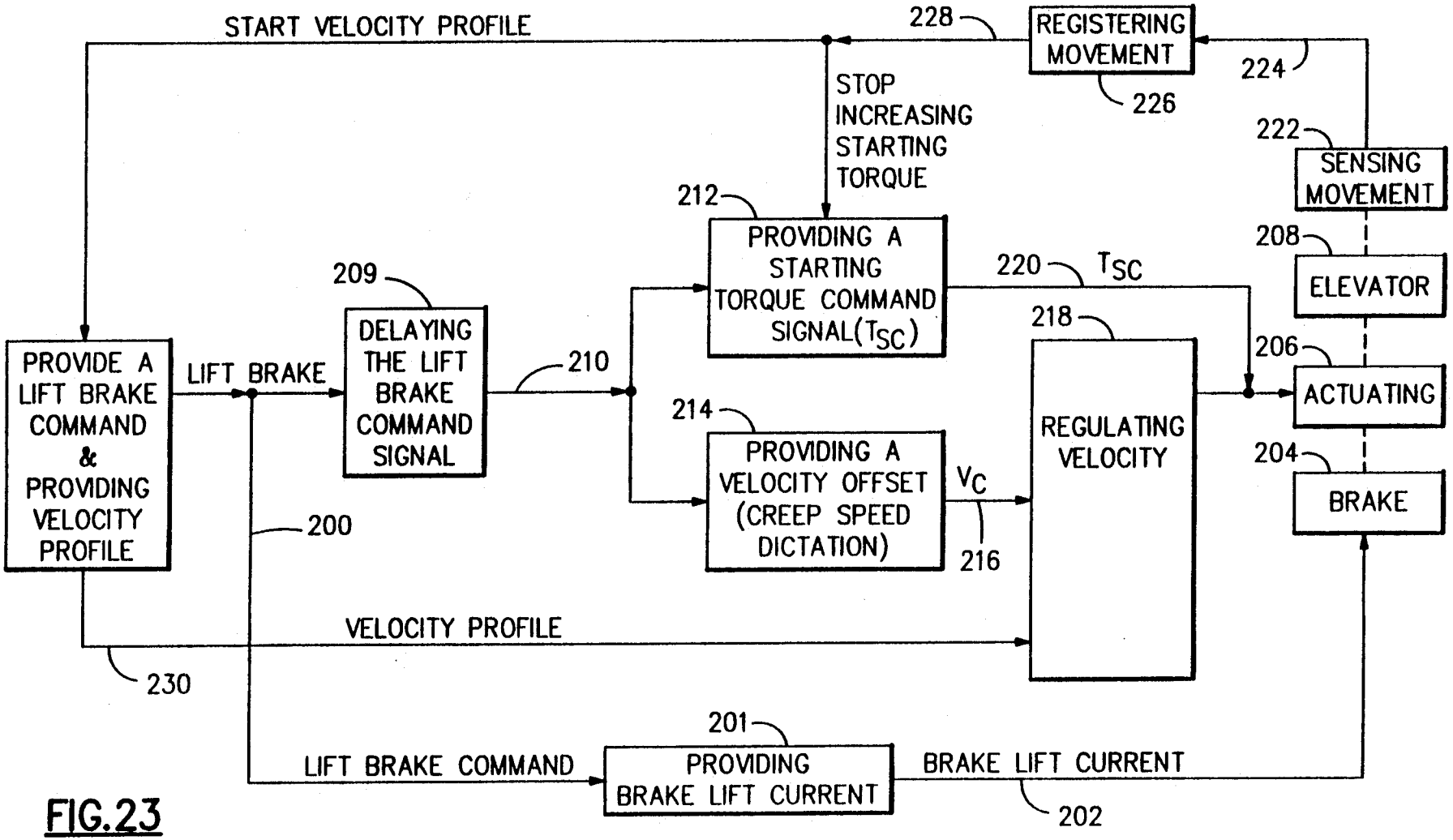
FIG. 23 shows a preferred method for carrying out the present invention.

FIG. 23 shows an illustrative method for carrying out the present invention on an embodiment thereof. Normally, in the prior art, in response to a start command (not shown), a lift brake signal is provided to means for effectuating brake lift by means of providing current, for example, sufficient to energize the brake to disengage from the actuating means or the elevator itself. At the same time, or sometime later, a velocity profile is started. In most cases, this command signal to start the lift brake signal and the velocity profile is provided in response to a command from other parts of the elevator control system in which it is determined that the elevator doors have closed and that the car is ready to respond to new hall calls or car calls registered within. However, according to the present invention, the velocity profile is not provided immediately, but, instead, a brake lift signal on a line 200 is provided in order to initiate providing a brake lift current by means 201 on a line 202 to a brake 204, which may actually act to mechanically brake an actuating means 206 or an elevator car 208. In addition, the lift brake signal on line 200 is delayed 209 by a delaying means which after a delay period of, for example, 0.5 second, provides a delayed lift brake signal on a line 210 to a means for providing 212 a start torque command signal and a means for providing 214 a velocity offset (creep speed dictation) signal ($V_c$) on a line 216 to a means for regulating 218 velocity. The means for providing a starting torque command signal provides a starting torque command signal ($T_{sc}$) on a line 220 to the actuating means 206 and, in effect, bypasses the means for regulating velocity, particularly on startup. After motion is detected by a sensing means 222, which provides a motion signal on a line 224, motion is registered in a registering means 226 which provides a signal on a line 228 which may be used by the means for providing a starting torque command signal 212 to stop increasing starting torque and which also may be used by the means of a velocity profile signal on a line 230 to the means for regulating velocity 218.

By providing a relatively low level creep speed dictation signal on the level of, for example, 5 millimeters per second, the sensed velocity due to the starting torque command signal will be compared to an actual, nonzero speed reference signal even when the velocity profile itself is zero or very near zero. This avoids unnecessarily jerking the car.

Although the invention has been shown and described with respect to a best mode embodiment thereof, it should be understood by those skilled in the art that the foregoing and various other changes, omissions, and additions in the form and detail thereof may be made therein without departing from the spirit and scope of the invention.

We claim:

1. A method for controlling an elevator actuator in a velocity control system having a speed reference signal compared to a sensed speed signal, comprising the steps of:

providing an increasing magnitude starting torque reference signal, in response to a lift brake signal, for increasing a torque provided by said elevator actuator; and stopping the increase of said starting torque reference signal in response to said sensed speed signal provided for starting said speed reference signal.

2. The method of claim 1, wherein said step of providing an increasing magnitude starting torque reference signal comprises the step of:

providing said increasing magnitude starting torque reference signal in response to said lift brake signal after a selected period.

3. The method of claim 1, further comprising the step of:

providing a creep speed reference signal for comparison with said sensed speed signal in response to said lift brake signal.

4. The method of claim 3, wherein said step of providing a creep speed reference signal comprises the step of:

providing said creep speed reference signal in response to said lift brake signal after a selected period.

5. The method of claim 1, wherein said step of stopping further comprises the step of decreasing the magnitude of said starting torque reference signal in response to said sensed speed signal for compensating for a transition from static brake friction to a lower sliding brake friction.

6. The method of claim 5, wherein said decrease of said starting torque reference signal has a magnitude selected according to the magnitude at which said starting torque reference signal is stopped.

7. The method of claim 1, wherein said step of providing an increasing magnitude starting torque reference signal comprises the step of:

providing said increasing magnitude starting torque reference signal in an exponentially increasing manner.

8. Apparatus for controlling an elevator actuator in a velocity control system having a speed reference signal compared to a sensed speed signal, comprising:

means for providing an increasing magnitude starting torque reference signal, in response to a lift brake signal, for increasing a torque provided by said elevator actuator; and means for stopping said increase of said starting torque reference signal in response to said sensed speed signal provided for starting said speed reference signal.

9. The apparatus of claim 8, wherein said means for providing an increasing magnitude starting torque reference signal comprises:

means for delaying for a selected period said providing of said increasing magnitude starting torque reference signal in response to said lift brake signal.

10. The apparatus of claim 8, further comprising:

means for providing a creep speed reference signal for comparison with said sensed speed signal in response to said lift brake signal.

11. The apparatus of claim 10, wherein said means for providing a creep speed reference signal comprises:

means for providing said creep speed reference signal in response to said lift brake signal after a selected period.

12. The apparatus of claim 8, wherein said means for stopping further comprises means for decreasing the magnitude of said starting torque reference signal in response to said sensed speed signal for compensating for a transition from static brake friction to a lower sliding brake friction.

13. The apparatus of claim 12, wherein said decrease of said starting torque reference signal has a magnitude selected according to the magnitude at which said starting torque reference signal is stopped.

14. The apparatus of claim 8, wherein said means for providing an increasing magnitude starting torque reference signal comprises:

means for providing said increasing magnitude starting torque reference signal in an exponentially increasing manner.

* * * * *